US005141004A

United States Patent [19]

Porenski

[11] Patent Number: 5,141,004

[45] Date of Patent: Aug. 25, 1992

[54] SMOKING ARTICLE

[75] Inventor: Harry S. Porenski, Bonaire, Ga.

[73] Assignee: Brown & Williamson Tobacco Corporation, Louisville, Ky.

[21] Appl. No.: 642,956

[22] Filed: Jan. 18, 1991

[51] Int. Cl.[5] ..... A24D 3/04

[52] U.S. Cl. ..... 131/194; 131/335; 131/359

[58] Field of Search ..... 131/194, 335, 359

[56] References Cited

U.S. PATENT DOCUMENTS

| | | | |
|---|---|---|---|
| 4,898,191 | 2/1990 | Johnson et al. | 131/359 |
| 4,917,121 | 4/1990 | Riehl et al. | 131/194 |
| 4,924,886 | 5/1990 | Litzinger | 131/194 |

FOREIGN PATENT DOCUMENTS

| | | | |
|---|---|---|---|
| 1185887 | 3/1970 | United Kingdom | 131/194 |

*Primary Examiner*—Vincent Millin

*Assistant Examiner*—J. Doyle

*Attorney, Agent, or Firm*—Charles G. Lamb; Charles I. Sherman

[57] ABSTRACT

The smoking section of the smoking article is comprised of a cylindrical combustible tube having a flavoring material therein, a combustible fuel element circumscribing the combustible tube and a wrapping material circumscribing the fuel element. A disc having a centrally disposed opening therethrough in flow-through communication with the flavoring material and the mouthpiece section is disposed to separate the smoking section from the mouth piece section. The disc receives a flow through connecting tube through the centrally disposed opening and sealing means is provided at the connection of the disc to the flow-through connecting tube to prevent the flow of fluids therethrough excepting those from the flavoring material contained in the cylindrical, combustible tube.

16 Claims, 1 Drawing Sheet

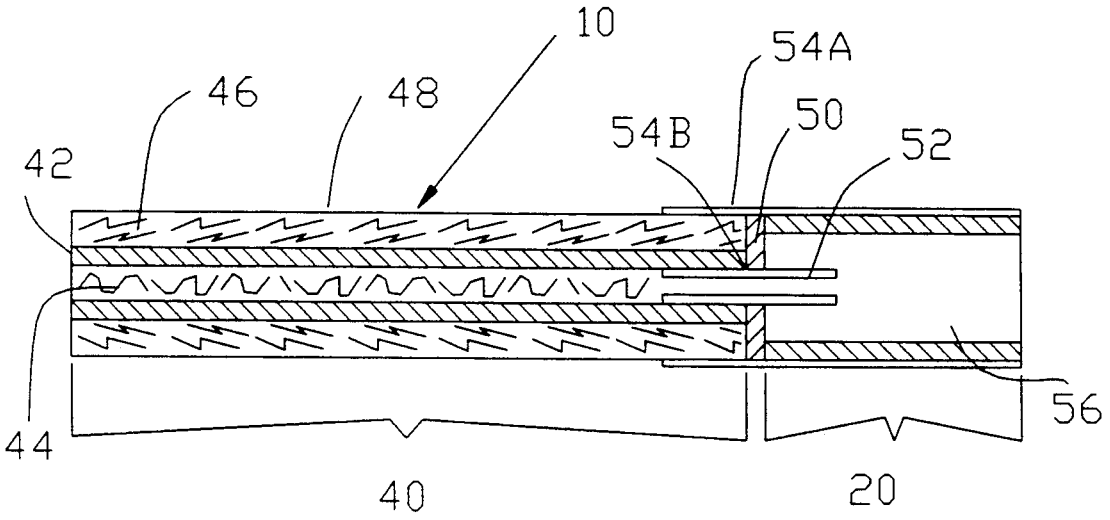
FIGURE

SMOKING ARTICLE

BACKGROUND OF THE INVENTION

Field of the Invention

The present invention relates to a smoking article. The present invention particularly relates to a smoking article wherein the flow of fluids passing from a smoking section into a mouthpiece section is restricted to fluids passing through a connecting tube.

SUMMARY OF THE INVENTION

The present invention is for a smoking article wherein a flavoring material is heated by a fuel source to emit a fluid which is to be inhaled by the smoker without inhaling smoke from the fuel source. More particularly, the present invention is for a smoking article comprising: a mouthpiece section; a smoking section, said smoking section comprising a cylindrical combustible tube having a flavoring material therein, a combustible fuel element circumscribing said combustible tube, and a wrapping material circumscribing said fuel element; a disc separating said smoking section from said mouthpiece section, said disc having a centrally disposed opening therethrough in flow-through communication with said flavoring material and said mouthpiece section, said disc receiving a flow-through connecting tube through said opening; and sealing means at least at the connection of said disc to said mouthpiece section to prevent the flow of fluids therethrough excepting through the flow-through connecting tube.

U.S. Pat. No. 3,258,015 ('015), to Ellis, teaches the use of a tubular member with an outwardly flared flange or annulus at its inner end. The heating means surrounds the tubular member. An outer wrapper touches the outside surface of the heating means and the circumference of the flange of the tubular member. However, the invention does not teach sealing means between the annulus and the outer wrapper. In fact, U.S. Pat. No. 3,356,094 ('094), also to Ellis, teaches that in the '015 patent smoke is likely to leak between the wrapper and the circumference of the annulus. Further, the '094 patent teaches passing small amounts of smoke from the heating means into the mouth to make the product more cigarette like. Therefore, in neither the '015 or the '094 patent is it taught that the smoke from the heating means should be prevented from entering the smoker's mouth.

DESCRIPTION OF THE DRAWINGS

A better understanding of the present invention will be had upon reference to the following description in conjunction with the accompanying drawing wherein:

The FIGURE is a cross-sectional view of the smoking article;

DETAILED DESCRIPTION OF THE PREFERRED EMBODIMENT

With reference to the FIGURE, there is shown a smoking article 10. The smoking article 10 contains a mouthpiece section 20 and a smoking section 40 separated by a disc 50.

Smoking section 40 comprises a cylindrical combustible tube 42, a flavoring material 44, a combustible fuel element 46, and a wrapping material 48. Cylindrical combustible tube 42 is hollow and extends axially from the upstream to downstream end of the smoking section. Examples of materials from which cylindrical combustible tube 42 can be constructed are paper or foil. The optimum inside diameter of the cylindrical combustible tube 42 is from about 3 to 4 mm. This provides sufficient air space so that when the flavorant is added a normal 3 to 5 inch tobacco section pressure drop is realized. Furthermore, in a preferred embodiment, the tube is wound an alumina trihydrate sheet (2 ply) of from 0.25 mm. to 0.5 mm. thickness.

Additionally, cylindrical combustible tube 42 can be treated with a burn retardant. Examples of this burn retardant include, for example, sodium chloride, as one preferred burn retardant. The purposes for the burn retardant are to decrease the chance of smoke from the burning of combustible fuel element 46 from entering the mouth of the smoker and to prevent flavoring material 44 from burning.

Flavoring material 44 is contained within cylindrical combustible tube 42. In general, flavoring material 44 is a material which when heated emits the desired flavor to the smoker. Specific examples include as a solid mix in a chopped, stranded, or coating condition. The mix is generally made from a dry collection of tobaccos that is combined with an aerosol generant such as glycerine or glycols and water.

Combustible fuel element 46 circumscribes cylindrical combustible tube 42. And, wrapping material 48 circumscribes both smoking section 40 and mouthpiece section 20. When smoking section 40 is ignited, the burning of combustible fuel element 46 causes flavoring material 44 to give off the desired flavor. Tobacco or carbon are examples of material which can be used for combustible fuel element 46.

Mouthpiece section 20 is shown as a hollow cylinder having approximately the same diameter as smoking section 40. Examples of materials which can be used to construct mouthpiece section 20 include tube wound kraft paper of 0.25 mm. wall thickness or an injection molded thermosetting plastic.

While not shown in the drawing, a cellulose filter element can be added to the downstream end of mouthpiece section 20 to give the appearance of a typical cigarette.

In addition, tipping paper may circumscribe the outside of the mouthpiece section 20 to give the appearance of a typical cigarette.

Mouthpiece section 20 and smoking section 40 are separated by a disc 50 with a centrally disposed opening through disc 50. Flow-through connecting tube 52 passes through the opening in disc 50 and provides flow-through communication between flavoring material 44 and mouthpiece section 20. Disc 50 may be constructed of for example paper, foil, or plastic. A preferred foil is generally a kraft backed, for example, 0.005 inch thick. A preferred plastic is a thermosetting type suitable for injection molding. And, plastic is a preferred material, especially as an integral part of a plastic mouthpiece section 20.

Flow-through connecting tube 52 may be constructed of graphite or carbon. An alternative construction would be to construct flow-through connecting tube 52 by winding multiple plies of a band cast sheet made from a slurry of insulating material with pulp, sodium carboxymethyl cellulate binder, glycerine, and water. One example of an insulating material is alumina trihydrate. And, preferrably, the pulp will be in the range of from about 3 to 5 percent by weight, the binder will be in the range of from about 10 to 12 percent by weight, the glycerine will be in the range of from about 6 to 8 percent by weight and the water will be from about 85 to 89 percent by weight.

For a generally acceptable product for commercial utilization, the flow-through connecting tube 52 should have an inside diameter of from about 2.5 mm. to 3.5 mm.

Sealing mean 54A and 54B are provided to prevent the flow of smoke from smoking section 40 into mouthpiece section 20 except through flow-through connecting tube 52. Sealing means 54A and 54B may be, for example, heat resistant epoxy around and between the connecting tube 52 and the opening in disc 50 as well as the outside diameter of disc 50 and wrapping material 48.

A nucleating chamber 56 is generally provided in the mouthpiece section 20. Chamber 56 keeps the total cigarette weight and pressure drop down. Particularly, if the combustible tube 42 and connecting tube 52 are relatively small, the nucleating chamber is needed to keep the pressure drop at a reasonable level.

The foregoing detailed description is given primarily for clearness of understanding and no unnecessary limitations are to be understood therefrom, for modifications can be made by those skilled in the art upon reading this disclosure, and may be made without departing from the spirit of the invention and scope of the appended claims.

What is claimed is:

1. A smoking article comprising:

a) a mouthpiece section;

b) a smoking section, said smoking section comprising a cylindrical combustible tube having a flavoring material therein; a combustible fuel element circumscribing said combustible tube; a wrapping material circumscribing said fuel element;

c) a disc separating said smoking section from said mouthpiece section, said disc having a centrally disposed opening therethrough in flow-through communication with said flavoring material and said mouthpiece section, said disc receiving a flow-through connecting tube through said opening; and d) sealing means connecting said disc to said flow-through connecting tube to prevent the flow of fluids from said smoking section to said mouthpiece section excepting through the flow-through connecting tube, said connecting tube being made from the group consisting of graphite or carbon.

2. The smoking article of claim 1 where said cylindrical combustible tube is treated with a burn retardant, said burn retardant being sodium chloride.

3. The smoking article of claim 1 where said combustible fuel element is selected from the group consisting of tobacco or carbon.

4. The smoking article of claim 1 where said sealing means is a heat resistant epoxy.

5. The smoking article of claim 1 where said disc is made from the group consisting of paper, foil, or plastic.

6. The smoking article of claim 1 where the cylindrical combustible tube is made from the group consisting of paper or thin foil.

7. The smoking article of claim 1 where said flow-through connecting tube has an inside diameter of from about 2.5 mm. to about 3.5 mm.

8. The smoking article of claim 1 where said cylindrical combustible tube has an inside diameter of from about 3 to 4 mm.

9. A smoking article comprising:

a) a mouthpiece section;

b) a smoking section, said smoking section comprising a cylindrical combustible tube having a flavoring material therein; a combustible fuel element circumscribing said combustible tube; a wrapping material circumscribing said fuel element;

c) a disc separating said smoking section from said mouthpiece section, said disc having a centrally disposed opening therethrough in flow-through communication with said flavoring material and said mouthpiece section, said disc receiving a flow-through connecting tube through said opening; and d) sealing means connecting said disc to said flow-through connecting tube to prevent the flow of fluids form said smoking section to said mouthpiece section excepting through the flow-through connecting tube, said flow-through connecting tube is made by winding multiple plies of a band cast sheet made from a slurry of insulating material with pulp, binder, glycerine, and water.

10. The smoking article of claim 9 where said disc is made from the group consisting of paper foil, or plastic.

11. The smoking article of claim 9 where the cylindrical combustible tube is made from the group consisting of paper or thin foil.

12. The smoking article of claim 9 wherein the pulp is from about 3 to 5 weight percent, the binder is from about 10 to 12 weight percent, the glycerine is from about 6 to 8 weight percent, and the water is from about 85 to 89 weight percent.

13. The smoking article of claim 9 where the insulating material is alumina trihydrate.

14. The smoking article of claim 9 where said cylindrical combustible tube is treated with a burn retardant, said burn retardant being sodium chloride.

15. The smoking article of claim 9 where said combustible fuel element is selected from the group consisting of tobacco or carbon.

16. The smoking article of claim 9 where said sealing means is a heat resistant epoxy.

* * * * *

UNITED STATES PATENT AND TRADEMARK OFFICE

CERTIFICATE OF CORRECTION

PATENT NO. : 5,141,004

DATED : August 25, 1992

INVENTOR(S) : Harry S. Porenski

It is certified that error appears in the above—identified patent and that said Letters Patent is hereby corrected as shown below:

On the title page, item [57]:

In the Abstract, before the first sentence, add --A smoking article comprising a smoking section and a mouthpiece section, wherein the fluids passing from the smoking section into the mouthpiece section are limited to those from a flavoring material contained in a central cylindrical combustible tube.--;

column 4, line 29, delete the word "form" and replace with --from--.

Signed and Sealed this

Twelfth Day of October, 1993

*Attest:*

Bruce Lehman

BRUCE LEHMAN

*Attesting Officer*

*Commissioner of Patents and Trademarks*